US009316964B2

(12) United States Patent
Yamaguchi et al.

(10) Patent No.: US 9,316,964 B2
(45) Date of Patent: Apr. 19, 2016

(54) FIXING DEVICE AND IMAGE FORMING APPARATUS

(71) Applicants: Yoshiki Yamaguchi, Kanagawa (JP); Yoshio Hattori, Kanagawa (JP); Ryuuichi Mimbu, Kanagawa (JP); Yasunori Ishigaya, Kanagawa (JP); Toshihiko Shimokawa, Kanagawa (JP); Kazuya Saito, Kanagawa (JP); Haruyuki Honda, Kanagawa (JP)

(72) Inventors: Yoshiki Yamaguchi, Kanagawa (JP); Yoshio Hattori, Kanagawa (JP); Ryuuichi Mimbu, Kanagawa (JP); Yasunori Ishigaya, Kanagawa (JP); Toshihiko Shimokawa, Kanagawa (JP); Kazuya Saito, Kanagawa (JP); Haruyuki Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/657,906

(22) Filed: Mar. 13, 2015

(65) Prior Publication Data

US 2015/0261148 A1 Sep. 17, 2015

(30) Foreign Application Priority Data

Mar. 17, 2014 (JP) ..... 2014-053821

(51) Int. Cl.
*G03G 15/20* (2006.01)

(52) U.S. Cl.
CPC ..... *G03G 15/2017* (2013.01); *G03G 15/2028* (2013.01); *G03G 2215/2032* (2013.01); *G03G 2215/2035* (2013.01)

(58) Field of Classification Search
CPC ..... G03G 2215/2035; G03G 15/2064; G03G 15/2053; G03G 2215/2016; G03G 2215/2032; G03G 2215/2009; G03G 15/2017; G03G 15/2032; G03G 15/2028; G03G 2215/2022; G03G 15/2067; G03G 2215/2025
USPC ..... 399/33, 122, 329
See application file for complete search history.

(56) References Cited

U.S. PATENT DOCUMENTS

| | | | | |
|---|---|---|---|---|
| 4,571,056 | A | 2/1986 | Tani et al. | |
| 4,618,240 | A * | 10/1986 | Sakurai | G03G 15/2053 219/216 |
| 5,105,228 | A * | 4/1992 | Kato | G03G 15/2035 399/122 |
| 5,724,638 | A * | 3/1998 | Isogai | G03G 15/2053 399/323 |
| 2006/0029443 | A1* | 2/2006 | Fukuda | G03G 15/2064 399/328 |
| 2007/0059017 | A1* | 3/2007 | Omura | G03G 15/5004 399/88 |
| 2007/0292175 | A1 | 12/2007 | Shinshi | |
| 2008/0050155 | A1* | 2/2008 | Miki | G03G 15/2064 399/328 |
| 2008/0317532 | A1 | 12/2008 | Ehara et al. | |
| 2009/0148204 | A1 | 6/2009 | Yoshinaga et al. | |
| 2010/0322684 | A1* | 12/2010 | Kikuchi | G03G 15/2042 399/331 |
| 2012/0070206 | A1* | 3/2012 | Tsukioka | G03G 15/2032 399/328 |

(Continued)

FOREIGN PATENT DOCUMENTS

| | | |
|---|---|---|
| JP | 59174869 | 10/1984 |
| JP | 4044075 | 2/1992 |
| JP | 2005011627 | 1/1993 |
| JP | 5-265339 | 10/1993 |
| JP | 8262903 | 10/1996 |
| JP | 2008272260 | 10/1996 |

(Continued)

*Primary Examiner* — Francis Gray
(74) *Attorney, Agent, or Firm* — Duft Bornsen & Fettig LLP

(57) ABSTRACT

A fixing device includes a first rotator and a second rotator pressed against the first rotator to form a fixing nip therebetween, through which a recording medium bearing a toner image is conveyed. A thermal insulation cover is disposed opposite the second rotator. A mover is connected to the second rotator to move the second rotator with respect to the first rotator. The mover is coupled with the thermal insulation cover to move the thermal insulation cover while retaining a predetermined interval between the thermal insulation cover and the second rotator.

18 Claims, 8 Drawing Sheets

(56) References Cited

U.S. PATENT DOCUMENTS

| | | | | |
|---|---|---|---|---|
| 2012/0114345 | A1 | 5/2012 | Fujimoto et al. | |
| 2012/0224869 | A1* | 9/2012 | Yamada | G03G 15/2017 399/33 |
| 2013/0188991 | A1 | 7/2013 | Kawata et al. | |
| 2013/0302073 | A1* | 11/2013 | Takeuchi | G03G 15/2039 399/328 |
| 2014/0270875 | A1 | 9/2014 | Mimbu et al. | |

FOREIGN PATENT DOCUMENTS

| | | |
|---|---|---|
| JP | 10213984 | 8/1998 |
| JP | 2007334025 | 12/2007 |
| JP | 2007334205 | 12/2007 |
| JP | 2010256562 | 1/2010 |
| JP | 2013186192 | 9/2013 |
| JP | 2013195502 | 9/2013 |
| JP | 2013235157 | 11/2013 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2014-053821, filed on Mar. 17, 2014, in the Japanese Patent Office, the entire disclosure of which is hereby incorporated by reference herein.

BACKGROUND

1. Technical Field

Exemplary aspects of the present disclosure relate to a fixing device and an image forming apparatus, and more particularly, to a fixing device for fixing a toner image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a first rotator and a second rotator pressed against the first rotator to form a fixing nip therebetween, through which a recording medium bearing a toner image is conveyed. A thermal insulation cover is disposed opposite the second rotator. A mover is connected to the second rotator to move the second rotator with respect to the first rotator. The mover is coupled with the thermal insulation cover to move the thermal insulation cover while retaining a predetermined interval between the thermal insulation cover and the second rotator.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a first rotator and a second rotator pressed against the first rotator to form a fixing nip therebetween, through which the recording medium bearing the toner image is conveyed. A thermal insulation cover is disposed opposite the second rotator. A mover is connected to the second rotator to move the second rotator with respect to the first rotator. The mover is coupled with the thermal insulation cover to move the thermal insulation cover while retaining a predetermined interval between the thermal insulation cover and the second rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
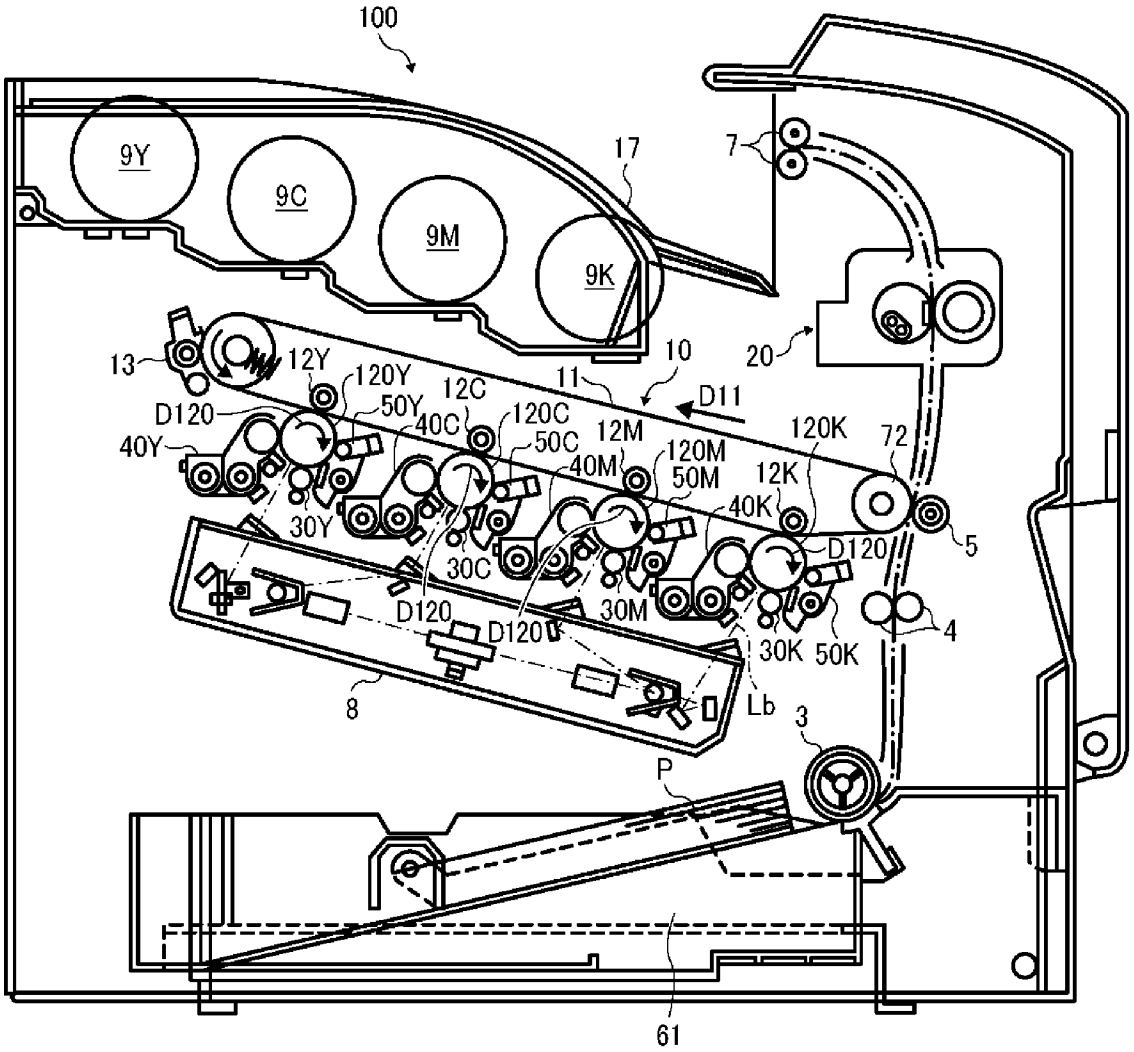
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on recording media by electrophotography. Alternatively, the image forming apparatus 100 may be a monochrome printer that forms a monochrome toner image on a recording medium.

With reference to FIG. 1, a description is provided of a construction of the image forming apparatus 100.

The image forming apparatus 100 is a color printer for forming a color toner image in a plurality of colors on a recording medium by electrophotography. Alternatively, the image forming apparatus 100 may be a monochrome printer for forming a monochrome toner image on a recording medium. The image forming apparatus 100 employs a tandem structure in which photoconductive drums 120Y, 120C, 120M, and 120K serving as image bearers that bear yellow, cyan, magenta, and black toner images in separation colors, respectively, are aligned.

The yellow, cyan, magenta, and black toner images formed on the photoconductive drums 120Y, 120C, 120M, and 120K, respectively, are primarily transferred successively onto a transfer belt 11 disposed opposite the photoconductive drums 120Y, 120C, 120M, and 120K as the transfer belt 11 rotates in a rotation direction D11 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium P (e.g., a recording sheet and a transfer sheet) collectively in a secondary transfer process.

Each of the photoconductive drums 120Y, 120C, 120M, and 120K is surrounded by image forming components that form the yellow, cyan, magenta, and black toner images on the photoconductive drums 120Y, 120C, 120M, and 120K as they rotate clockwise in FIG. 1 in a rotation direction D120. Taking the photoconductive drum 120K that forms the black toner image, the following describes an image forming operation to form the black toner image. The photoconductive drum 120K is surrounded by a charger 30K, a developing device 40K, a primary transfer roller 12K, and a cleaner 50K in this order in the rotation direction D120 of the photoconductive drum 120K. The photoconductive drums 120Y, 120C, and 120M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D120 of the photoconductive drums 120Y, 120C, and 120M, respectively. After the charger 30K charges the photoconductive drum 120K, an optical scanner 8 described below writes an electrostatic latent image on the photoconductive drum 120K.

As the transfer belt 11 rotates in the rotation direction D11, the yellow, cyan, magenta, and black toner images formed on the photoconductive drums 120Y, 120C, 120M, and 120K, respectively, are primarily transferred successively onto the transfer belt 11, thus being superimposed on the same position on the transfer belt 11. In the primary transfer process, the primary transfer rollers 12Y, 12C, 12M, and 12K disposed opposite the photoconductive drums 120Y, 120C, 120M, and 120K via the transfer belt 11, respectively, apply a transfer bias to the photoconductive drums 120Y, 120C, 120M, and 120K successively from the upstream photoconductive drum 120Y to the downstream photoconductive drum 120K in the rotation direction D11 of the transfer belt 11.

The photoconductive drums 120Y, 120C, 120M, and 120K are accommodated in process cartridges, respectively, and aligned in this order in the rotation direction D11 of the transfer belt 11. The photoconductive drums 120Y, 120C, 120M, and 120K are located in image forming stations that form the yellow, cyan, magenta, and black toner images, respectively.

A transfer belt unit 10 including the transfer belt 11 and the primary transfer rollers 12Y, 12C, 12M, and 12K disposed opposite the photoconductive drums 120Y, 120C, 120M, and 120K, respectively, via the transfer belt 11 is employed as a mechanism to perform the primary transfer process.

A secondary transfer roller 5, that is, a roller rotatable in accordance with rotation of the transfer belt 11, is disposed opposite a secondary transfer backup roller 72 via the transfer belt 11. The secondary transfer roller 5 secondarily transfers the yellow, cyan, magenta, and black toner images superimposed on the transfer belt 11 onto the recording medium P collectively.

In addition to the process cartridges and the transfer belt unit 10 described above, the image forming apparatus 100 further includes the optical scanner 8 serving as an optical writing device disposed opposite and below the four image forming stations and a cleaner 13 that cleans the transfer belt 11.

The optical scanner 8 includes a semiconductor laser serving as a light source, a coupling lens, an fθ lens, a troidal lens, a mirror, and a polygon mirror. The optical scanner 8 emits a laser beam Lb corresponding to each of yellow, cyan, magenta, and black image data onto each of the photoconductive drums 120Y, 120C, 120M, and 120K. In FIG. 1, a reference numeral Lb is assigned to a laser beam irradiating the photoconductive drum 120K. However, a laser beam also irradiates each of the photoconductive drums 120Y, 120C, and 120M. Thus, an electrostatic latent image is formed on each of the photoconductive drums 120Y, 120C, 120M, and 120K.

The image forming apparatus 100 further includes a paper tray 61, a feed roller 3, and a registration roller pair 4. The paper tray 61 loads a plurality of recording media P. The feed roller 3 picks up and feeds a recording medium P from the paper tray 61 to the registration roller pair 4. The registration roller pair 4 feeds the recording medium P to a secondary transfer nip formed between the secondary transfer roller 5 and the transfer belt 11 at a time when the yellow, cyan, magenta, and black toner images superimposed on the transfer belt 11 reach the secondary transfer nip. The image forming apparatus 100 further includes a sensor that detects a leading edge of the recording medium P as it reaches the registration roller pair 4.

After the yellow, cyan, magenta, and black toner images superimposed on the transfer belt 11 are secondarily transferred onto the recording medium P to form a color toner image thereon, the recording medium P is conveyed to a fixing device 20 where the color toner image is fixed on the recording medium P. The recording medium P bearing the fixed color toner image is ejected onto an output tray 17 disposed atop the image forming apparatus 100 through an output roller pair 7. The image forming apparatus 100 further includes toner containers 9Y, 9C, 9M, and 9K that supply fresh yellow, cyan, magenta, and black toners to the developing devices 40Y, 40C, 40M, and 40K of the four image forming stations, respectively.

A description is provided of a construction of the fixing device 20 incorporated in the image forming apparatus 100 described above.

Figure 2:
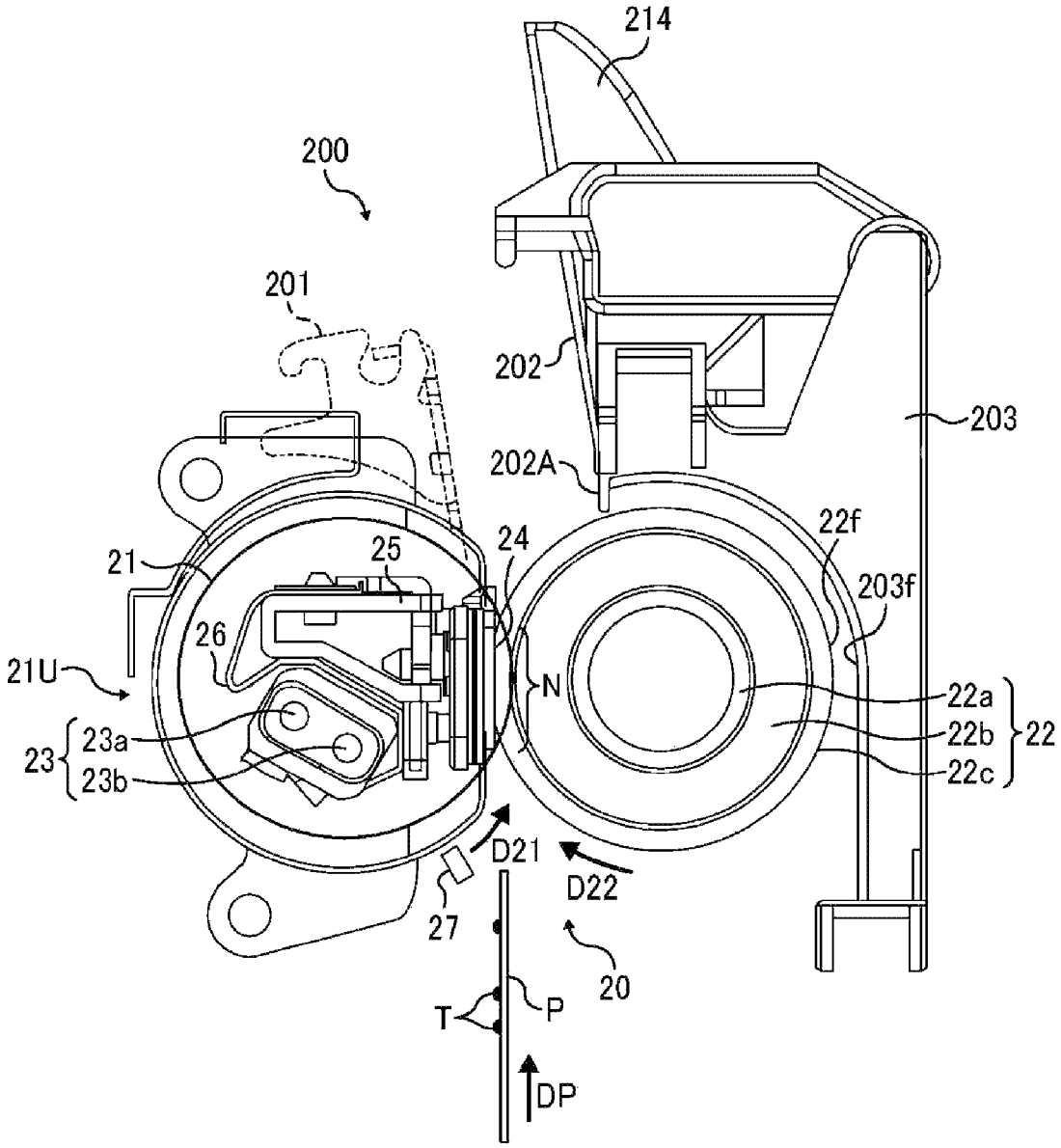
FIG. 2 is a schematic vertical sectional view of a fixing device installed in the image forming apparatus shown in FIG. 1.

FIG. 2 is a schematic vertical sectional view of the fixing device 20. As shown in FIG. 2, the fixing device 20 (e.g., a fuser or a fusing unit) includes a fixing belt 21 serving as a first rotator or a fixing rotator heated by a heater 23. The fixing device 20 applies heat and pressure to a toner image T on a recording medium P to cause toner of the toner image T to melt and permeate the recording medium P, thus fixing the toner image T on the recording medium P. The fixing belt 21 is a flexible endless belt rotatable in a rotation direction D21 while the fixing belt 21 is heated by the heater 23. The fixing device 20 further includes a pressure roller 22 and the heater 23. The pressure roller 22 serves as a second rotator, a pressure rotator, or an opposed rotator disposed opposite the fixing belt 21 and rotatable in a rotation direction D22. The pressure roller 22 is pressed against the fixing belt 21 to form a fixing nip N therebetween. The heater 23 includes a plurality of halogen lamps 23*a* and 23*b* that heats the fixing belt 21 in a circumferential span thereon outboard from the fixing nip N in a circumferential direction of the fixing belt 21.

Inside a loop formed by the fixing belt 21 are a nip formation pad 24 serving as a nip formation base, a stay 25 that contacts and supports the nip formation pad 24, and a reflector 26 that reflects light radiated from the heater 23 thereto toward the fixing belt 21. The fixing belt 21 and the components disposed inside the loop formed by the fixing belt 21, that is, the heater 23, the nip formation pad 24, the stay 25, and the reflector 26, may constitute a belt unit 21U separably coupled with the pressure roller 22.

The nip formation pad 24 includes a base pad and a slide sheet (e.g., a low-friction sheet) wrapping the base pad. The nip formation pad 24 shown in FIG. 2 is planar in cross-section to produce the planar fixing nip N. Alternatively, the nip formation pad 24 may have other shapes. For example, the nip formation pad 24 may be recessed along an outer circumferential surface of the pressure roller 22. In this case, the recessed nip formation pad 24 directs the leading edge of the recording medium P ejected from the fixing nip N to the pressure roller 22, facilitating separation of the recording medium P from the fixing belt 21.

A temperature sensor 27 disposed upstream from an entry to the fixing nip N in the rotation direction D21 of the fixing belt 21 and a recording medium conveyance direction DP in which the recording medium P is conveyed detects the temperature of the fixing belt 21. The detected temperature of the fixing belt 21 is used for feedback processing of the heater 23.

A detailed description is now given of a configuration of the fixing belt 21.

The fixing belt 21 is a thin, flexible endless belt, sleeve, or film. The fixing belt 21 is constructed of a base layer and a release layer coating the base layer. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like to facilitate separation of toner of the toner image T on the recording medium P from the fixing belt 21.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly described below presses the pressure roller 22 against the nip formation pad 24 via the fixing belt 21 such that the pressure roller 22 contacts the fixing belt 21 at the fixing nip N. The pressure roller 22 pressingly contacting the fixing belt 21 deforms the elastic layer 22*b* of the pressure roller 22 at the fixing nip N formed between the pressure roller 22 and the fixing belt 21. Accordingly, the nip formation pad 24 pressed by the fixing belt 21 produces the fixing nip N having a predetermined length in the recording medium conveyance direction DP.

A driver (e.g., a motor) disposed inside the image forming apparatus 100 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 2, according to this exemplary embodiment, the pressure roller 22 is a solid roller. Alternatively, the pressure roller 22 may be a hollow roller. In this case, a heater such as a halogen heater that radiates heat may be disposed inside the hollow pressure roller. If the hollow pressure roller does not incorporate the elastic layer 22*b*, the hollow pressure roller has a decreased thermal capacity that improves fixing property of being heated quickly to a predetermined fixing temperature at which the toner image T is fixed on the recording medium P properly. However, as the hollow pressure roller and the fixing belt 21 sandwich and press the toner image T on the recording medium P passing through the fixing nip N, slight surface asperities of the fixing belt 21 may be transferred onto the toner image T on the recording medium P, resulting in variation in gloss of the solid toner image T. To address this problem, it is preferable that the hollow pressure roller incorporates an elastic layer having a thickness not smaller than about 100 micrometers. The hollow pressure roller may include a metal tube or pipe made of aluminum, iron, stainless steel, or the like. If the heater is disposed inside the pressure roller 22, in order to suppress conduction of heat radiated from the heater to a support of the pressure roller 22, an insulation layer may coat the support or the support may mount a heat ray reflection face produced by mirror finishing. In this case, the heater may be a halogen heater, an induction heater (IH), a resistance heat generator, or a carbon heater.

A description is provided of a construction of a comparative fixing device A employing a belt.

Figure 3:
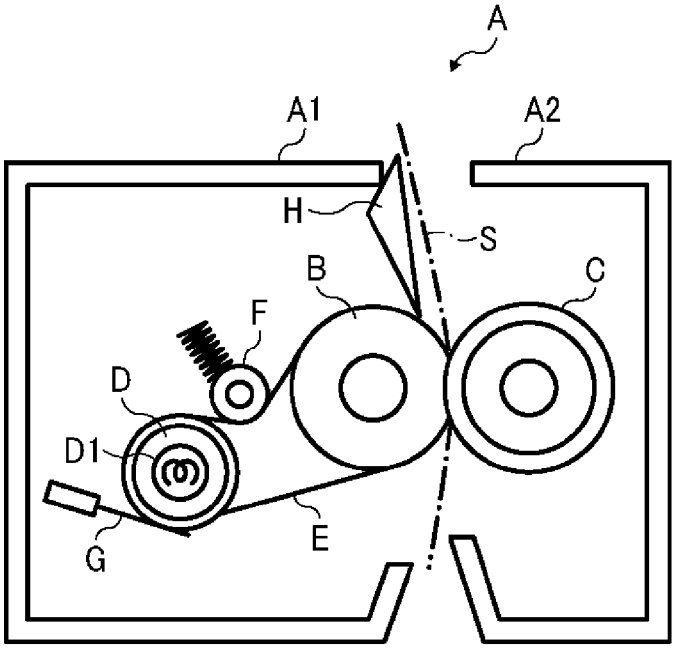
FIG. 3 is a vertical sectional view of a comparative fixing device.

FIG. 3 is a vertical sectional view of the comparative fixing device A. As shown in FIG. 3, the comparative fixing device A includes a fixing roller B and a pressure roller C disposed opposite the fixing roller B via a conveyance path where a recording medium S is conveyed. A fixing belt E is looped over the fixing roller B and a heating roller D isolated from the fixing roller B. The fixing belt E applied with tension from a tension roller F is rotated by the fixing roller B.

Inside the heating roller D is a heater D1. A thermistor G contacting an outer circumferential surface of the fixing belt E detects the temperature of the fixing belt E heated by the heater D1. Those components are housed by housing A1 and A2 of the comparative fixing device A. As the recording medium S bearing a toner image is conveyed through a fixing nip formed between the fixing belt E and the pressure roller C, the fixing belt E and the pressure roller C apply heat and pressure to the recording medium S, fixing the toner image on the recording medium S. A separation claw H disposed downstream from the fixing nip in a recording medium conveyance direction directs the recording medium S bearing the fixed toner image to an exit of the comparative fixing device A.

A description is provided of a construction of another comparative fixing device A' employing a belt.

Figure 4:
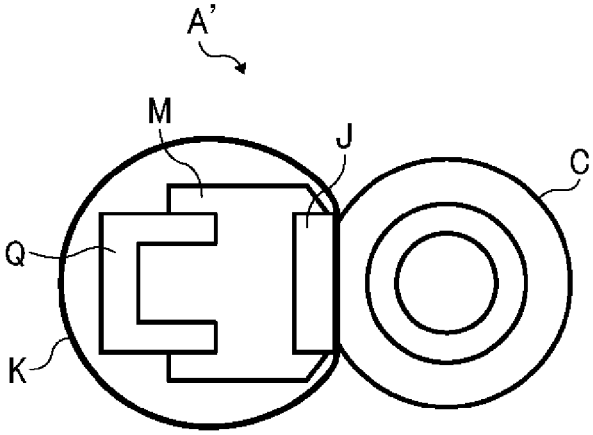
FIG. 4 is a vertical sectional view of another comparative fixing device.

FIG. 4 is a vertical sectional view of the comparative fixing device A'. As shown in FIG. 4, the comparative fixing device A' includes a heat generator J supported by a stay Q having a holder M. A belt, that is, a heat resistant film K, is sandwiched between the heat generator J and the pressure roller C to form a fixing nip between the film K and the pressure roller C. As a recording medium bearing a toner image is conveyed through the fixing nip, the film K heated by the heat generator J at the fixing nip and the pressure roller C apply heat and pressure to the recording medium, thus melting and fixing the toner image on the recording medium.

Heat generated by the comparative fixing devices A and A' may adversely affect peripheral devices surrounding the fixing devices A and A', such as the developing device 40K depicted in FIG. 1. If the developing device 40K is heated by heat dissipated from the fixing devices A and A', solidification of a developer (e.g., toner) contained in the developing device 40K may be accelerated, resulting in faulty development. To address this circumstance, a thermal insulation cover may surround the pressure roller C to reduce heat dissipation from the pressure roller C.

When the recording medium is jammed, pressure exerted at the fixing nip may be released or decreased. For example, the pressure roller C is isolated from the fixing belt E or the film K to allow a user to remove the jammed recording medium from the fixing nip. However, if the thermal insulation cover is disposed opposite the pressure roller C with a predetermined interval therebetween, as the pressure roller C moves, the predetermined interval between the thermal insulation cover and the pressure roller C may change. Accordingly, the changed interval may vary its volume, changing the temperature of the pressure roller C, which may result in overheating or temperature decrease of the pressure roller C. Consequently, the thermal insulation cover may not achieve predetermined insulation. It is requested to decrease the interval between the thermal insulation cover and the pressure roller C to suppress heat dissipation from the fixing nip. However, the decreased interval between the thermal insulation cover and the pressure roller C may cause the pressure roller C to come into contact with the thermal insulation cover as the pressure roller C separates from the fixing belt E or the film K, degrading a surface condition of the pressure roller C. To address this circumstance, the fixing device 20 includes a construction described below.

With reference to FIG. 2, a description is provided of a construction of a separation assembly 200 disposed downstream from the fixing nip N in the recording medium conveyance direction DP.

The separation assembly 200 is disposed in proximity to and downstream from an exit of the fixing nip N in the recording medium conveyance direction DP to separate the recording medium P ejected from the fixing nip N from the fixing belt 21 and the pressure roller 22 and guide the recording medium P to the output roller pair 7 that feeds the recording medium P onto the output tray 17 serving as an output portion depicted in FIG. 1. The separation assembly 200 includes a fixing belt oriented separator 201 having a tip in proximity to the fixing belt 21 and a pressure roller oriented separator 202 having a tip, that is, a separation claw 202A, in proximity to the pressure roller 22.

The fixing belt oriented separator 201 separates the recording medium P susceptible to adhesion to the fixing belt 21 from the fixing belt 21. Accordingly, the fixing belt oriented separator 201 is made of metal to achieve a precision in positioning the fixing belt oriented separator 201 at a proximal position where the fixing belt oriented separator 201 lifts the recording medium P adhered to an outer circumferential surface of the fixing belt 21 therefrom.

The pressure roller oriented separator 202 is made of a resin molding and includes the separation claw 202A serving as a separator situated in proximity to the outer circumferential surface of the pressure roller 22 to separate the recording medium P ejected from the fixing nip N from the pressure roller 22. The pressure roller oriented separator 202 is coupled with a thermal insulation cover 203 disposed opposite the pressure roller 22 serving as an opposed rotator with respect to the thermal insulation cover 203 with a predetermined interval therebetween. A part of the thermal insulation cover 203 constitutes the pressure roller oriented separator 202. The thermal insulation cover 203 is made of metal or resin and includes a cover face 203*f* disposed opposite and covering an opposite face 22*f* of the pressure roller 22 opposite a nip face of the pressure roller 22 disposed opposite the fixing nip N. The cover face 203*f* of the thermal insulation cover 203 is treated with mirror finishing if the cover face 203*f* is made of metal or treated with vapor deposition if the cover face 203*f* is made of resin, thus constituting a reflection face to reflect heat toward the fixing nip N so as to reduce power consumption of the heater 23.

Figure 5:
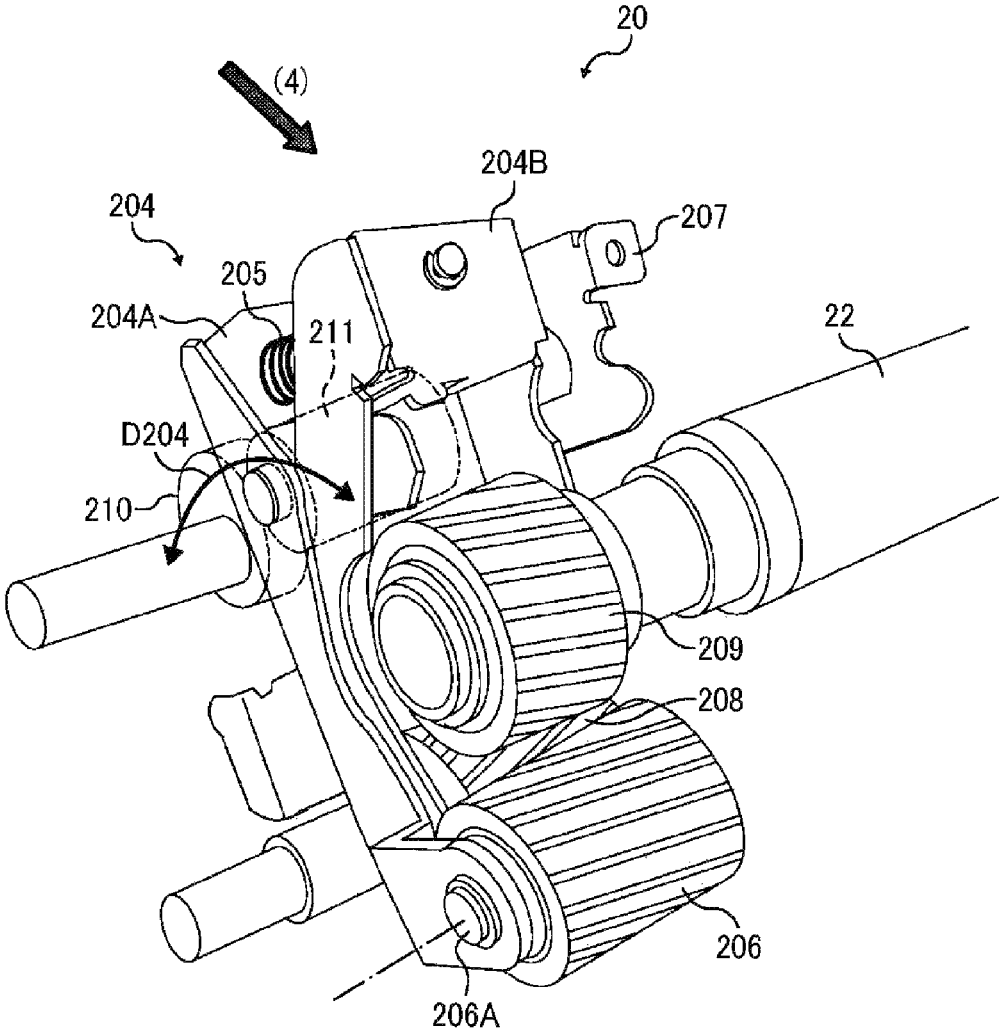
FIG. 5 is a partial perspective view of the fixing device shown in FIG. 2.

FIG. 5 is a partial perspective view of the fixing device 20. As shown in FIG. 5, the fixing device 20 includes a pressurization assembly 204 serving as a mover that moves the pressure roller 22 with respect to the fixing belt 21 depicted in FIG. 2. The pressurization assembly 204 is a contact-separation mechanism that supports and pivots the pressure roller 22 to bring the pressure roller 22 into contact with or separation from the fixing belt 21. The pressurization assembly 204 is coupled with the thermal insulation cover 203 depicted in FIG. 2 to move the thermal insulation cover 203 in accordance with movement of the pressurization assembly 204.

A description is provided of a construction of the pressurization assembly 204.

The pressurization assembly 204 includes a substrate 204A and a pressure roller biasing plate 204B pivotally supported by the substrate 204A. The pressure roller biasing plate 204B is pivotable about a lower end of the substrate 204A as a fulcrum. A spring 205 interposed between a pivot end of the substrate 204A and a pivot end of the pressure roller biasing plate 204B biases the pressure roller biasing plate 204B constantly to pivot the pressure roller biasing plate 204B toward the fixing belt 21.

Figure 6:
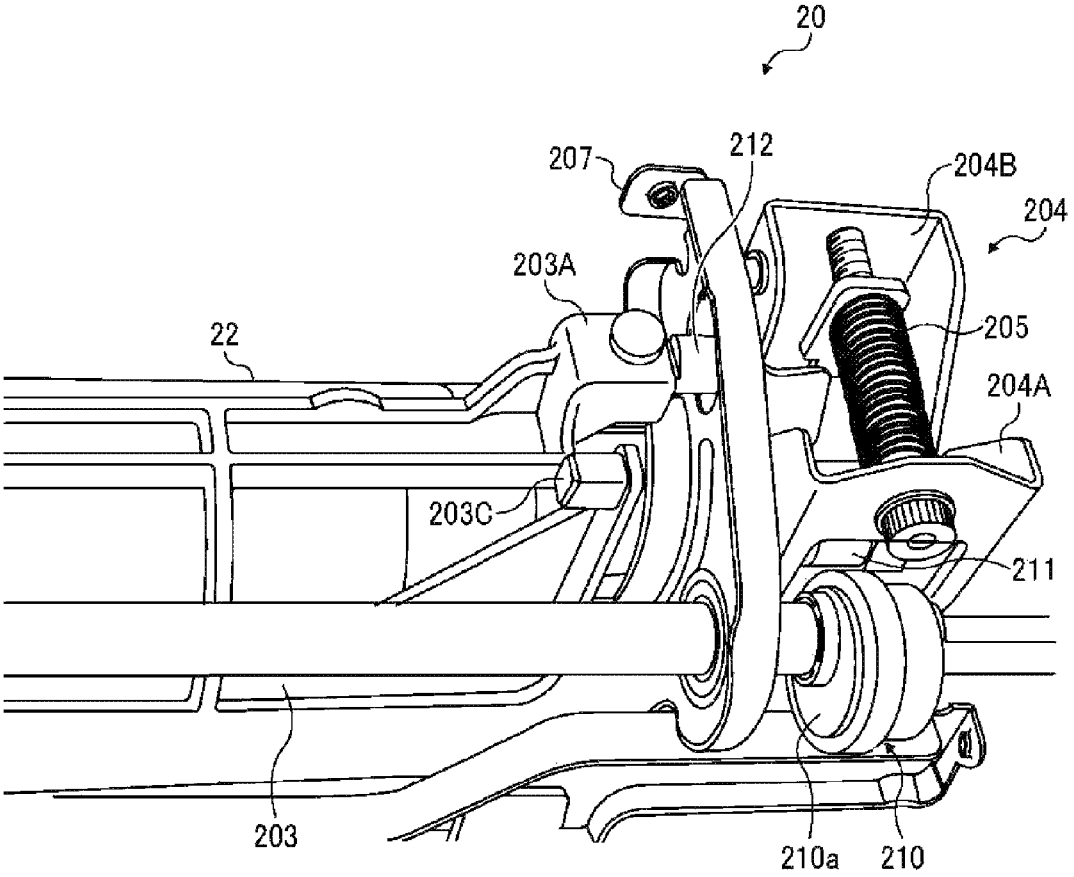
FIG. 6 is a partial perspective view of the fixing device seen from a direction (4) in FIG. 5.

The lower end of the substrate 204A mounts a support shaft 206A that rotatably supports an input gear 206 that receives a driving force transmitted from the driver located inside the image forming apparatus 100 depicted in FIG. 1. FIG. 6 is a partial perspective view of the fixing device 20 seen from a direction (4) in FIG. 5. As shown in FIG. 5, the input gear 206 engages an idle gear 208 supported by a mount plate 207 mounted on a frame of the image forming apparatus 100. The idle gear 208 engages an output gear 209 supported by a shaft of the pressure roller 22. The substrate 204A and the pressure roller biasing plate 204B are pivotable about the support shaft 206A of the input gear 206 as a fulcrum in a pivot direction D204. The pivot direction D204 is equivalent to a pressurization direction in which the pressurization assembly 204 presses the pressure roller 22 against the fixing belt 21 to exert pressure at the fixing nip N and a depressurization direction in which the pressurization assembly 204 releases pressure exerted between the pressure roller 22 and the fixing belt 21 at the fixing nip N.

As shown in FIGS. 5 and 6, the substrate 204A and the pressure roller biasing plate 204B are pivoted by an eccentric cam 210 disposed opposite a back face of the pivot end of the substrate 204A and a bearing 211 that is in contact with the eccentric cam 210 and rotatably supported by the substrate 204A. For example, as an increased diameter portion 210*a* of the eccentric cam 210 in rotation phase thereof presses against and moves the bearing 211, the pressurization assembly 204 moves the pressure roller 22 toward the fixing belt 21. Conversely, as the eccentric cam 210 rotates to change an opposed portion thereof disposed opposite the bearing 211 from the increased diameter portion 210*a* to a decreased diameter portion of the eccentric cam 210, the pressurization assembly 204 moves the pressure roller 22 relative to the fixing belt 21 in a direction in which pressure exerted between the pressure roller 22 and the fixing belt 21 at the fixing nip N is released.

Figure 7:
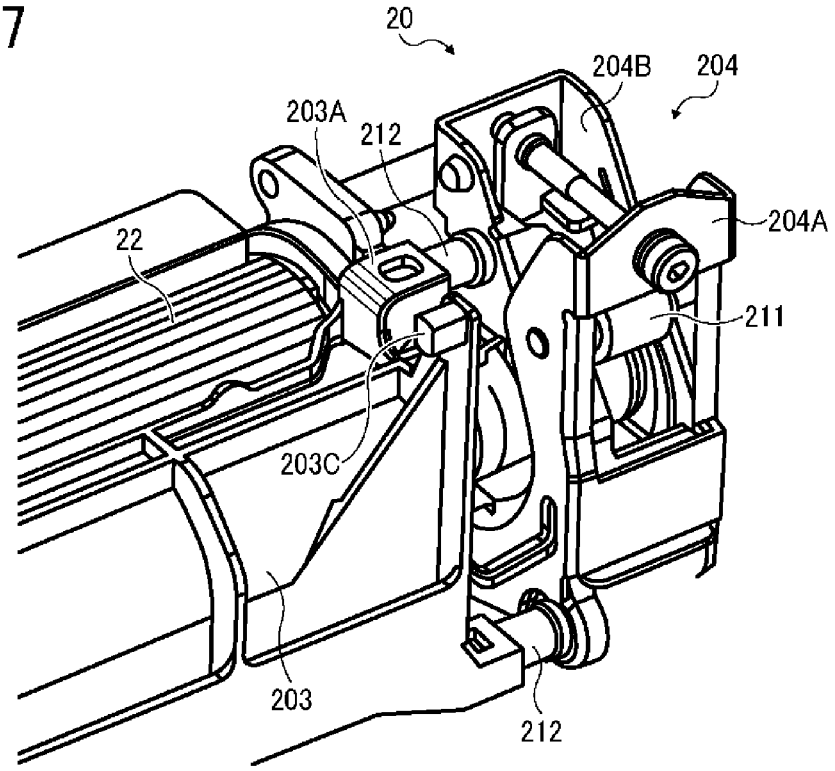
FIG. 7 is a partial perspective view of the fixing device shown in FIG. 2 illustrating a joint between a pressurization assembly and a pressure roller incorporated therein.
Figure 8:
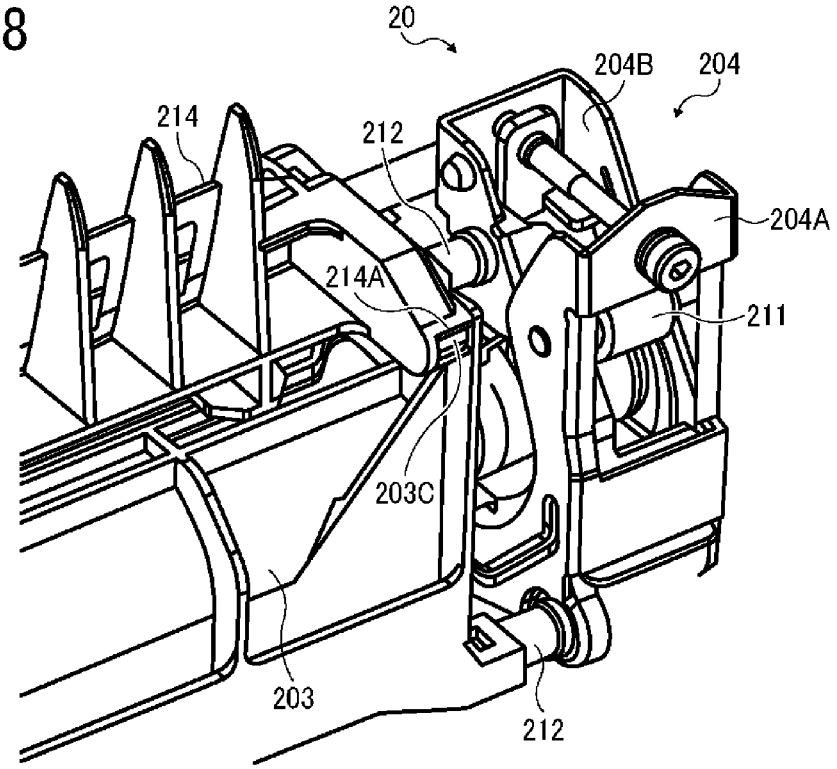
FIG. 8 is a partial perspective view of the fixing device shown in FIG. 2 illustrating a conveyance guide incorporated therein.

FIG. 7 is a partial perspective view of the fixing device 20 illustrating a joint between the pressurization assembly 204 and the pressure roller 22. FIG. 8 is a partial perspective view of the fixing device 20 illustrating a conveyance guide disposed opposite the pressure roller 22. As shown in FIG. 7, a part of the thermal insulation cover 203 interlocked with the pressurization assembly 204 mounts a pair of stud holders 203A into which a pair of studs 212 serving as a joint mounted on the pressurization assembly 204 is inserted. The studs 212 mounted on the pressure roller biasing plate 204B pivot relative to the substrate 204A together with the pressure roller biasing plate 204B. Accordingly, as the pressurization assembly 204 presses the pressure roller 22 against the fixing belt 21 in a pressurization direction, the thermal insulation cover 203 connected to the pressurization assembly 204 through the studs 212 moves in the pressurization direction. Conversely, as the pressurization assembly 204 separates the pressure roller 22 from the fixing belt 21 in a depressurization direction, the thermal insulation cover 203 moves in the depressurization direction. Thus, the thermal insulation cover 203 moves in accordance with movement of the pressure roller 22 in the pressurization direction and the depressurization direction in which the pressure roller 22 moves while retaining an interval between the thermal insulation cover 203 and the pressure roller 22. Hence, unlike the thermal insulation cover 203 not interlocked with the pressure roller 22, the thermal insulation cover 203 interlocked with the pressure roller 22 moves in accordance with movement of the pressure roller 22 in the identical direction and distance, thus retaining the identical interval between the thermal insulation cover 203 and the pressure roller 22 during both fixing and off-fixing. Consequently, even if the pressure roller 22 moves, the pressure roller 22 is immune from coming into contact with the thermal insulation cover 203 and temperature change that may arise as the interval between the thermal insulation cover 203 and the pressure roller 22 changes.

As shown in FIG. 8, the thermal insulation cover 203 serves as a pivot support of a conveyance guide 214 disposed in proximity to the thermal insulation cover 203 to guide the recording medium P conveyed through the fixing nip N. As shown in FIG. 7, an upper portion of the thermal insulation cover 203 mounts a guide support 203C on an identical face that mounts the stud holder 203A. As shown in FIG. 8, the guide support 203C is inserted into an engagement portion 214A mounted on the conveyance guide 214 disposed atop the thermal insulation cover 203. The guide support 203C is oval in cross-section to allow rotation after being inserted into the engagement portion 214A.

Since the conveyance guide 214 is coupled with and supported by the thermal insulation cover 203, when the thermal insulation cover 203 pivots in the depressurization direction in which the pressurization assembly 204 releases pressure between the pressure roller 22 and the fixing belt 21 exerted at the fixing nip N, the conveyance guide 214 moves in accordance with movement of the pressurization assembly 204 and the thermal insulation cover 203. Accordingly, the conveyance guide 214 pivots about the guide support 203C mounted on the thermal insulation cover 203. For example, as the pressurization assembly 204 releases pressure between the pressure roller 22 and the fixing belt 21 at the fixing nip N, the conveyance guide 214 pivots to expose a removal space through which the recording medium P is removed from the fixing nip N. Thus, the conveyance guide 214 pivots in a direction to open and close the removal space.

Figure 9:
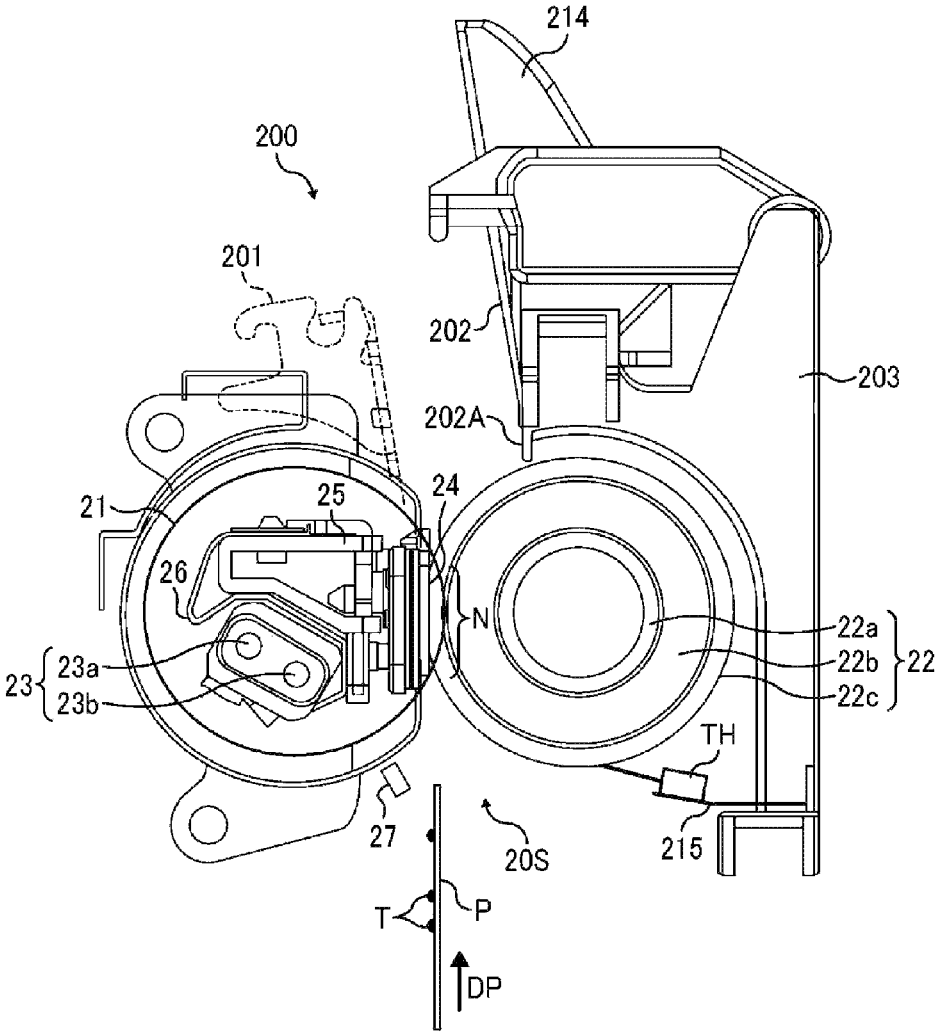
FIG. 9 is a schematic vertical sectional view of a fixing device according to another exemplary embodiment of the present disclosure.

The thermal insulation cover 203 serves as a support that supports a component requested to be disposed opposite the pressure roller 22 with a predetermined positional relation therebetween constantly as shown in FIG. 9. FIG. 9 is a schematic vertical sectional view of a fixing device 20S. As shown in FIG. 9, the fixing device 20S includes a pressure roller thermistor TH and a support 215 that are disposed in proximity to the pressure roller 22. The pressure roller thermistor TH serves as a detector contacting the outer circumferential surface of the pressure roller 22 to detect the temperature of the pressure roller 22. The support 215 mounts and supports the pressure roller thermistor TH, thus being coupled with the pressure roller thermistor TH. The thermal insulation cover 203 is mounted and coupled with the pressure roller thermistor TH that detects the temperature of the pressure roller 22 as a parameter of the pressure roller 22 that may affect fixing performance of fixing the toner image T on the recording medium P. The pressure roller thermistor TH detects the temperature of the pressure roller 22 to monitor fixing performance. Alternatively, the pressure roller thermistor TH may be replaced with other contact temperature detectors that detect the temperature of the pressure roller 22 by contacting it.

The pressure roller thermistor TH mounted on the thermal insulation cover 203 through the support 215 moves in accordance with movement of the thermal insulation cover 203 while retaining the predetermined positional relation between the pressure roller thermistor TH and the pressure roller 22 as the thermal insulation cover 203 moves in accordance with movement of the pressurization assembly 204 depicted in FIG. 5 as the pressurization assembly 204 presses the pressure roller 22 against the fixing belt 21 or separates the pressure roller 22 from the fixing belt 21.

A description is provided of a configuration of another component coupled with the thermal insulation cover 203.

Figure 10:
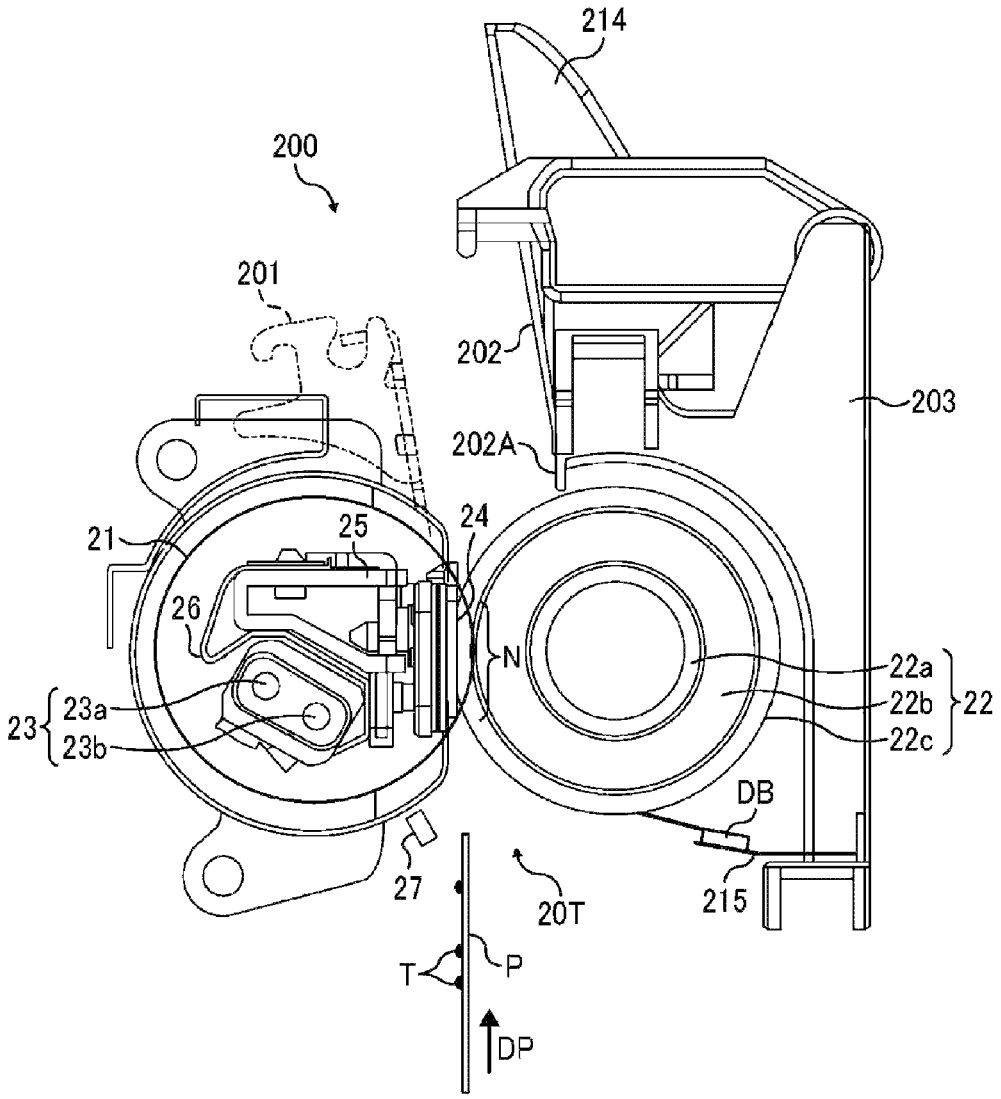
FIG. 10 is a schematic vertical sectional view of a fixing device according to yet another exemplary embodiment of the present disclosure.

FIG. 10 is a schematic vertical sectional view of a fixing device 20T. As shown in FIG. 10, the fixing device 20T includes a discharging brush DB serving as a discharger capable of contacting the outer circumferential surface of the pressure roller 22. The discharging brush DB is mounted on and supported by the support 215, thus being coupled with the thermal insulation cover 203 through the support 215.

The discharging brush DB requested to be disposed opposite the pressure roller 22 with the predetermined positional relation therebetween constantly moves in accordance with movement of the pressurization assembly 204 depicted in FIG. 5 through the thermal insulation cover 203 as the pressurization assembly 204 presses the pressure roller 22 against the fixing belt 21 and separates the pressure roller 22 from the fixing belt 21. Accordingly, the discharging brush DB is disposed opposite the pressure roller 22 with the predetermined positional relation therebetween constantly regardless of displacement of the pressure roller 22.

The present disclosure is not limited to the details of the exemplary embodiments described above, and various modifications and improvements are possible. For example, according to the exemplary embodiments described above, the pressure roller 22 is an opposed rotator disposed opposite the thermal insulation cover 203. Alternatively, the fixing belt 21 may be an opposed rotator disposed opposite the thermal insulation cover 203. Yet alternatively, both the pressure roller 22 and the fixing belt 21 may be opposed rotators disposed opposite the thermal insulation cover 203.

A description is provided of advantages of the fixing devices 20, 20S, and 20T.

As shown in FIGS. 2, 9, and 10, the fixing devices 20, 20S, and 20T include two rotators, that is, a first rotator (e.g., the fixing belt 21) and a second rotator (e.g., the pressure roller 22). The second rotator is pressed against the first rotator to form the fixing nip N therebetween, through which the recording medium P bearing the toner image T is conveyed. The thermal insulation cover 203 is disposed opposite the second rotator. A mover (e.g., the pressurization assembly 204 depicted in FIG. 5) connected to the second rotator moves the second rotator with respect to the first rotator. For example, the mover brings the second rotator into contact with or separation from the first rotator. The mover is coupled with the thermal insulation cover 203 to move the thermal insulation cover 203 while retaining a predetermined interval between the thermal insulation cover 203 and the second rotator.

Accordingly, regardless of the position of the second rotator relative to the first rotator, the thermal insulation cover 203 retains the predetermined interval between the second rotator and the thermal insulation cover 203, maintaining insulation of the thermal insulation cover 203 and preventing the second rotator from coming into contact with the thermal insulation cover 203.

The advantages achieved by the fixing devices 20, 20S, and 20T are not limited to those described above.

According to the exemplary embodiments described above, the fixing belt 21 serves as a first rotator. Alternatively, a fixing film, a fixing sleeve, a fixing roller, or the like may be used as a first rotator. Further, the pressure roller 22 serves as a second rotator. Alternatively, a pressure belt or the like may be used as a second rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a first rotator;

a second rotator pressed against the first rotator to form a fixing nip therebetween, through which a recording medium bearing a toner image is conveyed;

a thermal insulation cover disposed opposite the second rotator; and a mover connected to the second rotator to move the second rotator with respect to the first rotator, the mover coupled with the thermal insulation cover to move the thermal insulation cover while retaining a predetermined interval between the thermal insulation cover and the second rotator.

2. The fixing device according to claim 1, wherein the mover presses the second rotator against the first rotator and separates the second rotator from the first rotator.

3. The fixing device according to claim 1, wherein the thermal insulation cover is interlocked with the mover to move in accordance with movement of the second rotator.

4. The fixing device according to claim 1, further comprising a conveyance guide mounted on the thermal insulation cover to guide the recording medium conveyed through the fixing nip.

5. The fixing device according to claim 4, further comprising:

an engagement portion mounted on the conveyance guide; and a guide support mounted on the thermal insulation cover and inserted into the engagement portion.

6. The fixing device according to claim 1, further comprising a detector coupled with the thermal insulation cover to detect a parameter of the second rotator that affects fixing performance of fixing the toner image on the recording medium.

7. The fixing device according to claim 6, wherein the detector includes a thermistor disposed opposite the second rotator to detect a temperature of the second rotator.

8. The fixing device according to claim 6, wherein the parameter of the second rotator is a temperature of the second rotator.

9. The fixing device according to claim 1, further comprising a discharger contacting the second rotator to discharge the second rotator, the discharger coupled with the thermal insulation cover.

10. The fixing device according to claim 1, further comprising a separator disposed downstream from the fixing nip in a recording medium conveyance direction to separate the recording medium ejected from the fixing nip from the second rotator, the separator coupled with the thermal insulation cover.

11. The fixing device according to claim 1, further comprising a gear interposed between the mover and the second rotator.

12. The fixing device according to claim 11, wherein the mover includes:

a substrate supporting the gear; and a biasing plate pivotally supported by the substrate.

13. The fixing device according to claim 12, further comprising:

a stud holder mounted on the thermal insulation cover; and a stud mounted on the biasing plate and inserted into the stud holder, the stud pivotable with the biasing plate relative to the substrate.

14. The fixing device according to claim 12, further comprising:

a bearing rotatably supported by the substrate of the mover; and an eccentric cam disposed opposite the substrate and contacting the bearing, the eccentric cam including an increased diameter portion to press against the bearing to cause the mover to move the second rotator toward the first rotator.

15. The fixing device according to claim 1, wherein the second rotator includes an opposite face opposite the fixing nip and covered by the thermal insulation cover.

16. The fixing device according to claim 1, wherein the thermal insulation cover includes a reflection face disposed opposite the second rotator to reflect heat toward the fixing nip.

17. The fixing device according to claim 1, wherein the first rotator includes a fixing belt and the second rotator includes a pressure roller.

18. An image forming apparatus comprising:

an image bearer to bear a toner image; and a fixing device disposed downstream from the image bearer in a recording medium conveyance direction to fix the toner image on a recording medium, the fixing device including:

a first rotator;

a second rotator pressed against the first rotator to form a fixing nip therebetween, through which the recording medium bearing the toner image is conveyed;

a thermal insulation cover disposed opposite the second rotator; and a mover connected to the second rotator to move the second rotator with respect to the first rotator, the mover coupled with the thermal insulation cover to move the thermal insulation cover while retaining a predetermined interval between the thermal insulation cover and the second rotator.

* * * * *